US011414225B2

(12) United States Patent
Brettschneider et al.

(10) Patent No.: US 11,414,225 B2
(45) Date of Patent: Aug. 16, 2022

(54) STRAPPING TOOL

(71) Applicants: Kay Brettschneider, Schwelm (DE); Nils Horch, Herdecke (DE); Bastian Protzmann, Wuppertal (DE); Christian Noelke, Duesseldorf (DE)

(72) Inventors: Kay Brettschneider, Schwelm (DE); Nils Horch, Herdecke (DE); Bastian Protzmann, Wuppertal (DE); Christian Noelke, Duesseldorf (DE)

(73) Assignee: TITAN UMREIFUNGSTECHNIK GMBH & CO. KG, Schwelm (DE)

( * ) Notice: Subject to any disclaimer, the term of this patent is extended or adjusted under 35 U.S.C. 154(b) by 351 days.

(21) Appl. No.: 16/790,795

(22) Filed: Feb. 14, 2020

(65) Prior Publication Data

US 2020/0262593 A1 Aug. 20, 2020

(30) Foreign Application Priority Data

Feb. 15, 2019 (EP) ..... 19157442

(51) Int. Cl.
*B65B 13/22* (2006.01)
*B65B 13/02* (2006.01)
*B65B 13/18* (2006.01)

(52) U.S. Cl.
CPC ..... *B65B 13/22* (2013.01); *B65B 13/02* (2013.01); *B65B 13/187* (2013.01)

(58) Field of Classification Search
CPC ..... B65B 13/02; B65B 13/22; B65B 13/187; B65B 13/30; B65B 13/305; B65B 13/32; B65B 13/322; B65B 13/327; B65B 13/34; B65B 13/345; B65B 65/02; B65B 57/00; B65B 59/04
See application file for complete search history.

(56) References Cited

U.S. PATENT DOCUMENTS

| | | | | |
|---|---|---|---|---|
| 6,131,634 | A | 10/2000 | Chang | |
| 6,584,892 | B2 | 7/2003 | Flaum | |
| 8,281,711 | B2 * | 10/2012 | Haberstroh | B65B 13/22 100/32 |
| 8,904,925 | B2 * | 12/2014 | Haberstroh | B65B 13/18 100/29 |
| 9,254,932 | B2 | 2/2016 | Neeser | |
| 9,972,849 | B2 | 5/2018 | Yamazaki | |
| 10,370,132 | B2 | 8/2019 | Flaum | |
| 2013/0284033 | A1 * | 10/2013 | Bell, Jr. | B65B 13/22 100/32 |

FOREIGN PATENT DOCUMENTS

EP 1413519 A 4/2004

* cited by examiner

*Primary Examiner* — Jimmy T Nguyen
(74) *Attorney, Agent, or Firm* — Andrew Wilford

(57) ABSTRACT

A strapping tool has a tensioner for tightening a strap, a sealer for fixing together ends of the strap, a base, and a drive mounted on the base for operating the tensioner and sealer. The sealer or tensioner is a module removably attached to the base. A transponder is provided on the module and a reader on the base for wirelessly communicating with the transponder. A controller is connected to the reader for operating the tool.

14 Claims, 2 Drawing Sheets

STRAPPING TOOL

FIELD OF THE INVENTION

The present invention relates to a strapping tool. More particularly this invention concerns a strapping tool.

BACKGROUND OF THE INVENTION

A standard strapping tool has a tensioner, a sealer, and a drive. The tensioner or the sealer can be to be optionally coupled with the drive as a base, and each built as a module formed as an interchangeable complex element within the strapping tool.

Strapping tools can be used, for example, to guide a strapping band around objects to be strapped, to tension the strap by the tensioner, and to connect or seal together the strap ends at a closure in the sealer. In the case of a plastic strapping band, the closure is typically produced by friction welding, for example.

In principle, however, strapping bands made of steel can also be processed with such strapping tools and looped around objects to be strapped and secured. In this case, the sealer may a crimper that fits a locking clip around the ends of the strap to be connected and press it tightly around these ends of the strap. In principle, however, such steel straps can also be crimped together without a clip.

U.S. Pat. No. 6,584,892 deals very generally with modular components in connection with strapping machines. The modularity means that a respective feed and take-up mechanism can be positioned at a desired location.

In U.S. Pat. No. 8,281,711 a tensioner is described that can be separated from its drive. A feed head is described in this reference. This portable strapping tool can be driven in different directions of rotation and thereby operatively connected to a first subassembly and a second subassembly. The first subassembly can be a tensioner, while the second subassembly is embodied as a welder or cutter.

The design of the tensioner and/or sealer in such a strapping tool described in the prior art has the general advantage that it is not only possible for example to do different things at different connection points of the strapping tool. Also, interchangeability also opens up the possibility of either replacing or overhauling individual complex elements in the event of a problem.

This leaves however a fundamental problem in providing a clear association between the respective element or subassembly on the one hand and the respective strapping tool on the other hand. No compelling approaches to a solution have existed in the prior art as yet in this respect.

OBJECTS OF THE INVENTION

It is therefore an object of the present invention to provide an improved strapping tool.

Another object is the provision of such an improved strapping tool that overcomes the above-given disadvantages, in particular whose field of application or mode of operation can be changed in a simple and targeted manner.

SUMMARY OF THE INVENTION

A strapping tool has according to the invention tensioner for tightening a strap, sealer for fixing together ends of the strap, a base, and a drive mounted on the base for operating the tensioner and sealer. One of the means is a module removably attached to the base. A transponder is provided on the module and a reader on the base for wirelessly communicating with the transponder. Control means is connected to the reader for operating the tool.

In the context of the invention, the module in question refers to an interchangeable, complex, and closed subassembly, that is, to an interchangeable complex element within an overall system, namely the strapping tool. The approach taken is preferably such that the module in question or the tensioner and/or the sealer and its drive can be connected to or separated from one another not only mechanically but also in terms of data technology.

First of all, the module and the drive are mechanically releasably connected to one another, for instance by removable screws or bolts. This enables the module to be easily removed from the drive and reconnected thereto. Consequently, the module can be serviced at the factory, replaced with a new module, or even updated. The module is particularly the tensioner or sealer. As will readily be understood, the module can also be a feeder, a discharge unit, etc. In order to achieve and provide an unambiguous link between the module and its drive in this context, the data link between the respective module and the drive is additionally provided to also ensure a connection and separation of the two above-described elements. The data coupling enables the module to be provided with a type of "electronic stamp" or "electronic imprint." By virtue of this electronic stamp or imprint, the module can be clearly identified and coupled with the drive. For this purpose, the drive has a reader that requests the stamp or the imprint and checks it for a match.

In order to implement this in detail according to the invention, the module is equipped with the transponder that communicates with the reader on the drive. According to the invention, such a transponder has at least one antenna, a circuit for receiving and transmitting and/or exchanging data with the reader and, finally, a nonvolatile memory. The above-described data of the electronic stamp or the electronic imprint are stored in the memory. The entire transponder can be a microcontroller that advantageously works passively or in an energy-independent manner. This means that the reader in the drive not only reads data from or writes to the memory of the transponder, but also ensures with its radio signals that the energy required for transmission and operation in the transponder are available through induction. In fact, a passive transponder is especially advantageous in the context of the invention because, on the one hand, there is no additional energy supply and the transponder can thus have an especially compact design. On the other hand, there is typically only a small distance between the transponder and the reader, which makes energy supply by induction possible. In fact, one interpretation of the configuration that has proven to be especially favorable here is one in which the data link in question is operative only when the module and drive are at close range, generally in consideration of a distance of no more than 20 cm and particularly no more than 10 cm or less between the module and the drive. The data link is thus designed to be especially secure and protected against any manipulation or external reading.

In this context, it has proven to be especially expedient if the transponder is a near-field communication (NFC) chip. In this context, the data link between the module and the drive typically operates not only wirelessly, but also with a transmission speed of at least 100 Kbyte/second. In most cases, transmission speeds of up to 500 Kbytes/second or even more are observed.

Moreover, the data link generally operates in the frequency range above 25 kHz. The operating range is typically from 25 kHz to 14 MHz. The data link typically employs radio-frequency identification (RFID) technology. This means that electromagnetic waves in the above-given frequency range above 25 kHz are exchanged between the transponder and the reader and are used here for automatic and contactless identification of the respective module on the part of the drive or with the aid of the reader in the drive. In addition, data can be written to and read from the transponder from the reader.

Since NFC chips, which also work passively and in an energy-independent manner, are generally used here, and they can have an especially compact design and typically have the size of a grain of rice or can also be mounted on or in the module to be equipped without any difficulty in the form of an adhesive label. The module in question can thus be equipped inexpensively, permanently, and without any difficulty with the electronic stamp or electronic imprint mentioned above. As soon as the module is brought into close proximity with the reader, the reader checks the module in order to determine whether or not it can work with the strapping tool in question.

In general, both module-specific data and load-specific data can be stored in the transponder. The module-specific data is an article number, a production number, a year of manufacture, a version number or the like of the module in question. This means that the module in question is individualized using the module-specific data in the sense of the above-described electronic stamp or electronic imprint. In addition to the module-specific data, service-specific data is also stored in the transponder. This service-specific data can be information about the number of work cycles completed by the module in question, for example. In addition, peak loads or general mechanical loads on the relevant module can thus be displayed and stored in the transponder.

In order to achieve and implement this in detail, a controller is usually provided that at least records the load-specific data and transmits it to the transponder. At least one sensor is connected to the controller for this purpose. The sensor can be used, for example, to determine the locking force in a sealer. The number of work cycles can be calculated from this and stored in the transponder. In addition, the locking force can be evaluated in order to determine whether or not individual or multiple thresholds are exceeded and thus whether or not there are peak loads. The number of peak loads and their size can thus also be stored in the transponder. Alternatively or in addition, the sensor can also be used to evaluate the tensioning force in a tensioner in a comparable manner and convert it into corresponding load-specific data that are stored in the transponder.

In principle, the module-specific data can also be written into the transponder by the controller. It is also possible, however, for the module-specific data that ultimately individualizes the module in question to be able to be written into the transponder from the outset only at the factory and then no longer be able to be changed. In this case, the controller merely ensures, for example, that the load-specific data acquired with the aid of the sensor are transmitted by the controller to the transponder in addition to the fixed module-specific data.

As already explained, the transponder can be mounted in or on the module in question. Mounting the transponder in or on a base plate or housing of the sealer has proven to be especially advantageous here. In this case, the sealer plus the base plate and the transponder mounted thereon are thus embodied as a module, more particularly as a sealing module. In addition, the transponder can be integrated into this base plate, meaning, for example, that it can be fitted into a recess in the base plate and cast therein in order to avoid damage.

The sealer as a whole can be a component of the sealing module. The sealing module generally has a reduction gear and a transmission means. This enables the drive, with interposition of the reduction gear and the transmission means as a whole, to work on the sealer or the sealing module. This will be explained in more detail with reference to a specific embodiment.

As a result, a strapping tool is provided that enables simple and functional replacement of the tensioner and/or sealer, each of which is preferably embodied as a module. The module in question and the drive are paired mechanically or by data systems technology. The data pairing takes place occurs via a data link between a transponder or NFC chip on or in the module and its reader on or in the drive.

In this context, the reader determines not only the exact association of the module with the strapping tool in question on the basis of the module-specific data stored in the transponder, but rather the load-specific data are also stored in the transponder. These load-specific data can, also, be read out with the aid of an external reader that is provided at the factory, for example, in order to provide authoritative information for a possible replacement and for the targeted exchanging of any wearing parts of the module in question. The load-specific data can then be read out when the module is removed from the drive and is to be overhauled at the factory, for example.

In principle, however, it is also possible for the load-specific data to be stored in the transponder and, for example, to be transmitted to any location via a data interface of the machine-side reader or strapping tool. This makes it possible, for example, for a manufacturer of the strapping tool in question to take necessary measures in advance of a possible replacement or servicing of the module, such as procuring spare parts, reserving service time, etc. Herein lie the fundamental advantages.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
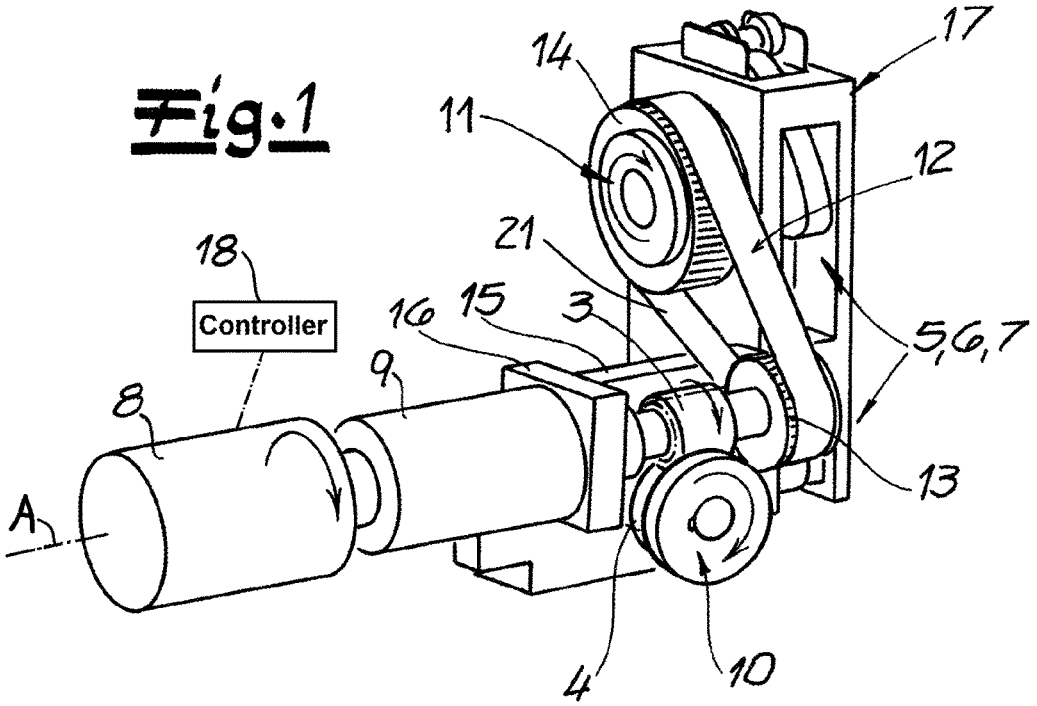
FIG. 1 is a perspective and partly schematic view of the invention.

As seen in FIG. 1 a strapping tool or machine is intended to connect together ends of a strap 1 with a seal 2. First the strap 1 is wrapped tightly around an unillustrated object and one of the strap ends is laid atop the other strap end. Then the clip 2 is fitted over the overlying strap ends and crimped together to lock the strap 1 in position on the object. Here the strip 1 is of steel, as is the clip 2. It is also within the scope of the invention to use a plastic strip, usually reinforced with inextensible fibers or filaments, and to friction or otherwise weld the strip ends together.

According to this embodiment, the strapping tool has a tensioner 3, 4 and a sealer or sealing means 5, 6, 7. A single electric motor 8 is used in this embodiment. The motor 8, with interposition of a transmission 9, serves overall as a drive 8, 9 for operating the tensioner 3, 4 on the one hand and the sealer 5, 6, 7 on the other hand, particularly in an alternating and reciprocal manner as described in more detail below. The electric motor 8 and the transmission 9 collectively define the drive 8, 9.

According to the invention, the tightening means or tensioner 3, 4 and the sealing means or sealer 5, 6, 7 are equipped with respective input freewheels 10, 11. In fact, the tensioner freewheel 10 is operated alternately with the sealer freewheel 11. Depending on the direction of rotation of the electric motor 8, the freewheel 10 acts on the tensioner 3, 4 and the freewheel 11 on the sealer 5, 6, 7. According to this embodiment, the sealer freewheel 11 blocks the locking operation or the sealer 5, 6, 7 shown in FIG. 2 in a counterclockwise direction. In contrast, clockwise blocking is provided for by the tensioner freewheel 10. Consequently, the sealer freewheel 11 freewheels in the clockwise direction, and the tensioner freewheel 10 freewheels in the counterclockwise direction. Thus the motor 8 switches between the tensioner 3, 4 and the sealer 5, 6, 7 simply by reversing rotation direction.

The sealer 5, 6, 7 is powered through a transmission 12 on the output side of the tensioner 3, 4. In fact, the sealer transmission 12 has reduction gearing 13, 14 on the sealer 5, 6, 7. The reduction gearing 13, 14 according to this embodiment is formed by two sprockets 13, 14 connected by an endless toothed belt 21. The speed reduction provided here by the reduction gearing 13, 14 results from the fact that the first gear 13 connected on the input or drive side to the electric motor 8 and the transmission 9 is provided with a smaller number of teeth than the second gear 14 that drives the sealer 5, 6, 7 with the aid of the transmission 12.

The sealer 5, 6, 7 is axially offset relative to a rotation axis A of the output shaft of the transmission 9 from the drive 8, 9. In fact, a drive base plate 15 extends axially from the drive 8, 9 and is releasably connected to a housing 17 of the sealer 5, 6, 7. In comparison, the tensioner 3, 4 extends perpendicular to the axial direction of the electric motor 8, including the transmission 9 and the drive plate 15. According to this embodiment, a mounting flange 16 is provided that connects the motor 8, along with the downstream transmission 9, to the drive plate 15 parallel thereto.

Figure 3:
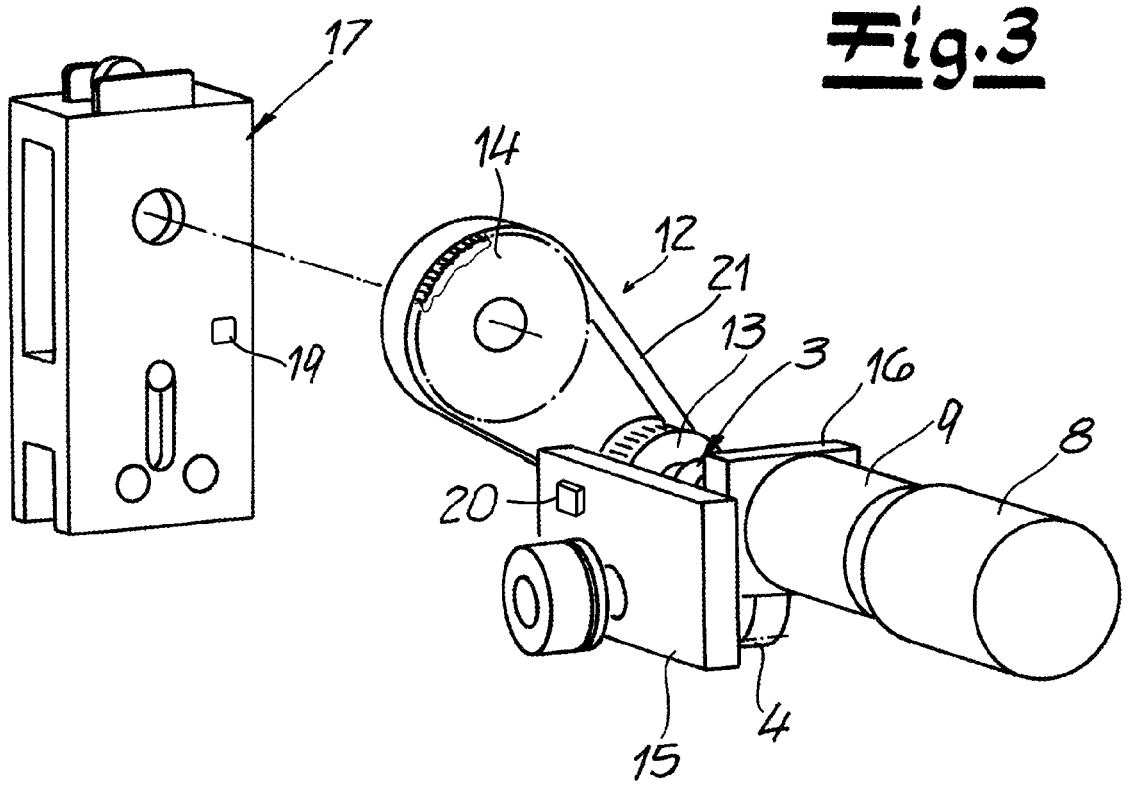
FIG. 3 is another such view but with the sealer separated from the system.

FIG. 3 shows that the sealer 5, 6, 7, along with the transmission 12, is embodied as a base module 5, 6, 7; 12; 13, 14. It is for this purpose that the base module 5, 6, 7; 12; 13, 14 has the plate 15. The plate 15 can be detached from the housing 17 and coupled therewith therefrom. As a result, the sealer 5, 6, 7, along with the base housing 17 that carries and supports it, can be removed from the drive plate 15, the motor 8 along with the transmission 9, and the reduction gear 13, 14 and transmission 12, and can be coupled thereto again as needed. Together with the base housing 17 and a transponder 19 attached thereto, the sealer 6, 7, 8 defines a sealing module 5, 6, 7; 17, 19 that can be interchangeably coupled with and decoupled from the drive 8, 9.

This is done as follows. The tensioning drive or the tensioning function is shown here starting from FIG. 1. This corresponds to rotation about the axis A of an output shaft of the electric motor 8 and, consequently, also of the downstream transmission 9 in the clockwise direction indicated here. The clockwise rotation of the electric motor 8 and of the downstream transmission 9 is transmitted to a worm gear 4 via a worm 3 attached to the output shaft. For this purpose, the output worm 3 rotates with the axially extending motor output shaft. In contrast, the worm gear 4 is oriented vertically and thereby also performs a rotary movement in the clockwise direction. Since its tensioner freewheel 10 locks in a clockwise direction, the rotational movement of the worm wheel 4 is consequently transmitted to one or more drive rollers, so that the tensioner 3, 4 as a whole ensures that the steel strap 1 that is wrapped around the objects to be strapped is tensioned. This corresponds to opposite movement of ends of the steel strap 1 in the axial direction as indicated in FIG. 2.

This tensioning process continues until a sensor determines that the required tensioning force has been reached. According to this embodiment as shown in FIG. 1, the design is such that the current consumption of the electric motor 8 is measured by an unillustrated sensor and fed to a controller 18. If the current consumption of the electric motor 8 exceeds a certain threshold that is preset in the controller 18, this is interpreted as an adequate tensioning force. Consequently, the controller 18 ensures that the tensioning function described above and shown in FIG. 1 is switched to the sealing function according to FIG. 2. In contrast to the tensioner freewheel 10, which is locked in the indicated clockwise direction and consequently ensures the described tensioning process of the steel strap 1, the sealer freewheel 11 runs freely during this process. This is because the clockwise rotation of the output shaft of the electric motor 8 along with the downstream gear 9 is transmitted via the first gear wheel 13 to the second gear wheel 14 with interposition of the toothed belt 21. The second gear wheel 14, which is provided with the sealer freewheel 11, also rotates in the clockwise direction. Since the sealer freewheel 11 freewheels clockwise, two crimping or sealing clamps 7, which are shown in FIG. 2 and responsible for the process of the locking of the steel strap 1 as part of the sealer 5, 6, 7, are not acted upon.

Figure 2:
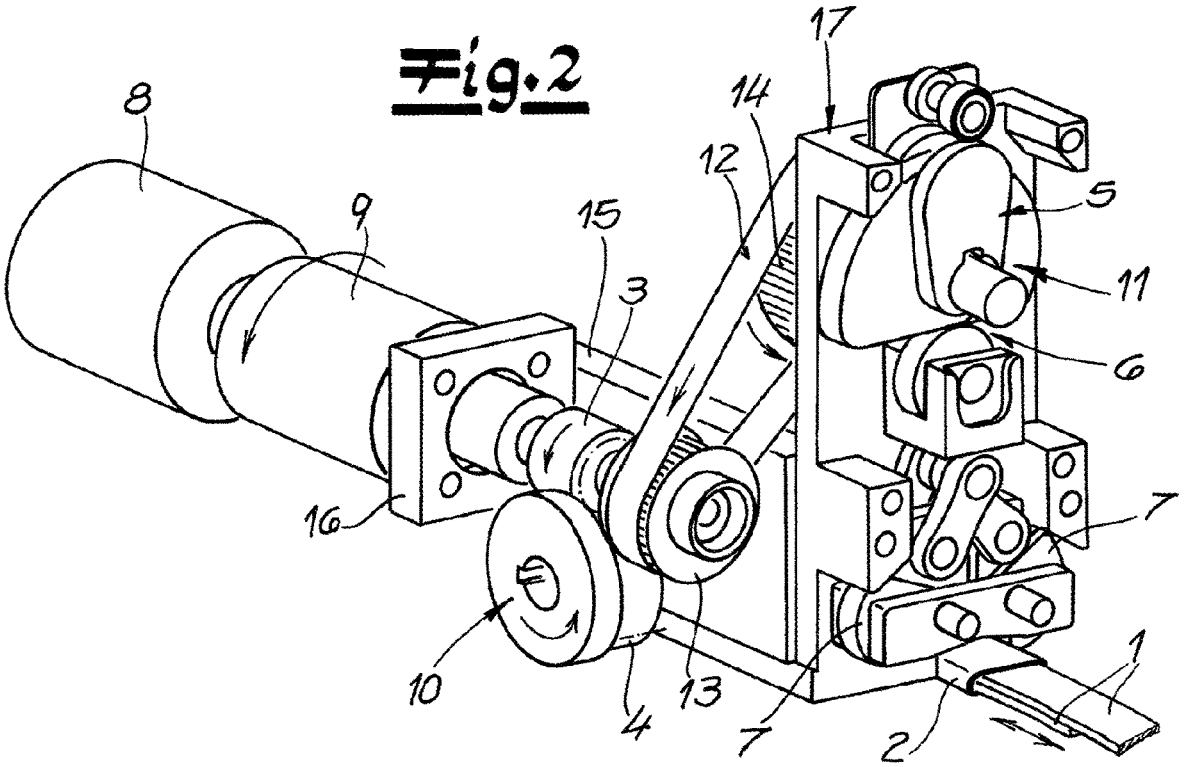
FIG. 2 is another view like FIG. 1 but from a different angle.

If the desired tensioning force is reached and the value for the current consumption of the electric motor 8 exceeds the above-described threshold, the controller 18 reversed rotation of the electric motor 8 so that it rotates counterclockwise as shown in the FIG. 2. Now the electric motor 8, along with the transmission 9, ensures that the sealer 5, 6, 7 is actuated. This is because the counterclockwise rotation of the electric motor 8 shown in FIG. 2 has the effect on the output side of the transmission 9 that the output worm 3 that is arranged on the output shaft also rotates in the counterclockwise direction. As a result, the sealer freewheel 10 rotates counterclockwise and is therefore freewheeling. The one or more rollers or tensioning wheels are consequently no longer acted upon. At the same time, the counterclockwise rotation of the electric motor 8 along with the downstream transmission 9 ensures that the sealer freewheel 11 rotates counterclockwise and is consequently blocked. This means that rotation of the second gear 14 are transmitted to a cam 5 of the sealer 5, 6, 7. The cam 5, in turn, acts upon an interposed lever linkage 6 that ensures overall that the above-described clamps 7 move toward one another and are closed transverse to the longitudinal extension of the steel strap 1. As a result, the clip 2 indicated in FIG. 2 is pressed onto the edges of the steel strap 1 that are to be joined. This results in the ends of the clip 2 and the edges of the strap 1 are permanently and plastically deformed and coupled together. During this process, a first reduction of the rotational movements of the fast-running electric motor 8 occurs on the one hand with the aid of the transmission 9 and, on the other hand, a further reduction occurs with the aid of the second reduction gear 13, 14. Considerable torque can thus be exerted on the locking clip 2 with the aid of the electric motor 8 for pressing.

The electric motor 8 is coupled as a whole to a rechargeable battery that acts as its electrical power supply. The battery may be in removably or fixedly mounted in a housing. The strapping tool shown can work as a handheld device or as a stationary device.

Finally, FIG. 3 shows the possibility of removing the sealer 5, 6, 7 from the plate 15 together with the base housing 17. This enables the base housing 17 with the cams 5 mounted thereon, the linkage 6, and the two locking clamps 7 to be exchanged and, if necessary, serviced.

In the context of this embodiment, in particular according to FIG. 3, the sealer 5, 6, 7 is embodied as part of the described sealing module 5, 6, 7; 17, 19. Alternatively or in addition, the tensioner 3, 4 or a feeder or discharge unit for the steel strap 1 can in principle also a module, but this is not shown. The module or the sealer 5, 6, 7 and, specifically, the sealing module 6, 7, 8; 17, 19 according to this embodiment can be optionally coupled with and removed from the drive 8, 9 as the base.

It is essential to the invention that the module or the sealer 5, 6, 7 in the example shown be not only mechanically coupled with the drive 8, 9, but that a data link be additionally provided between the module and the drive. This data link can also be separate. In order to implement the data link in detail, the sealer 5, 6, 7 is equipped with the transponder 19, which is an NFC chip 19 in this embodiment. The drive 8, 9, in turn, has a reader 20 that wirelessly works with the transponder or NFC chip 19 and that is coupled via the reader 20 to the controller 18.

According to this embodiment, both module-specific data and load-specific data are stored in a nonvolatile memory of the transponder or the NFC chip 19, as has already been described above. In this embodiment, the module-specific data include the article number, production number, and the year of manufacture of the sealer 5, 6, 7 and, if applicable, the base housing 17 carrying it. As will readily be understood, this is only for the sake of example and not to be understood as restrictive in any way. In addition, load-specific data are also recorded and evaluated with the aid of the transponder or the NFC chip 19. These load-specific data are made available by a sensor to the controller 18 that, as described, evaluates the current consumption of the electric motor 8 and, for example, transmits the exceeding of a threshold as a load peak to the controller 18. What is more, the sensor in question that is detecting the current consumption of the electric motor 8 can also be used to detect the number of work cycles completed by the sealer 5, 6, 7 and written into the NFC chip 19 with the aid of the controller 18 via the reader 20.

According to this embodiment, the transponder or NFC chip 19 operates in a passive or energy-independent manner. Moreover, the NFC chip 19 in question is integrated into the base housing 17 carrying and supporting the sealer 5, 6, 7 or attached to the base housing 17 in question. In fact, the NFC chip 19 may be embedded in a recess and sealed therein with plastic material and received in a protected manner. In principle and as shown, the NFC chip 19 can also be attached to the base housing 17 as an adhesive label.

As already described above, the data link between the module or the sealer 5, 6, 7 and hence the transponder 19 and the drive 8, 9 or the reader 20 there takes place at a transmission rate of at least 100 kbyte/second at close range. This means that the distance between the module in question or the sealer 5, 6, 7 and the drive 8, 9 is in a range below 10 cm when the module or the sealer 5, 6, 7 is in the assembled state. This enables data to be exchanged between the reader 20 and the NFC chip 19 in an especially secure and practically manipulation-free manner. In addition, the reader 20 can thereby supply the transponder 19 with power inductively. The data link is operative in the frequency range above 100 kHz up to several gigahertz.

In this way, it can be determined with the aid of the reader 20 as a component of the drive 8, 9 whether or not the relevant module or the sealer 5, 6, 7 matches with the relevant drive 8, 9 in the example shown. Only then can the NFC chip 19 and the reader 20 be "paired." In principle and in addition, the reader 20 in question can also be provided and implemented at a remote location, for example at the factory of the manufacturer of the strapping tool. In this case, the module or the sealer 5, 6, 7 or its NFC chip 19 is read out using the reader 20 provided there and in addition to the machine-side reader. Conclusions for the required revision can be drawn from the data that is read out, particularly from the load-specific data. This can also be performed in advance in the event that the load-specific data and possibly also the module-specific data are transmitted in the factory via a data line or a data interface.

We claim:

1. A strapping tool comprising:
tensioning means for tightening a strap;
sealing means for fixing together ends of the strap;
a base;
a drive mounted on the base and connected to the tensioning means and sealing means for operating the tensioning means and the sealing means, one of the means being a module removably attached to the base;
a transponder on the module;
a reader on the base for wirelessly communicating with the transponder; and
control means connected to the reader for operating the tool.

2. The strapping tool according to claim 1, wherein the transponder and the reader form a data link between the controller and the one means removably attached to the base.

3. The strapping tool according to claim 1, wherein the transponder has a memory holding module-specific data and load-specific data.

4. The strapping tool according to claim 3, the module-specific data is an article number, production number, year of manufacture, or version number of the module in question and load-specific data reflecting a number of work cycles completed and peak loads.

5. The strapping tool according to claim 3, wherein the control means receives the load-specific data from the reader and transmits the received load-specific data to the transponder.

6. The strapping tool according to claim 1, wherein the control means senses a locking or clamping force of the sealing means.

7. The strapping tool according to claim 1, wherein the transponder is passive or energy-independent.

8. The strapping tool according to claim 1, wherein the transponder is an NFC chip.

9. The strapping tool according to claim 1, wherein the sealing means has a housing carrying the transponder.

10. The strapping tool according to claim 1, wherein the sealing means is part of the module.

11. The strapping tool according to claim 1, wherein the sealing means has a speed-reducing transmission connectable to the drive.

12. The strapping tool according to claim 1, wherein the transponder and the reader communicate wirelessly at a rate of at least 100 kbyte/second.

13. The strapping tool according to claim 1, wherein the transponder and the reader communicate wirelessly only when within at most 20 cm of each other.

14. The strapping tool according to claim 1, wherein the transponder and the reader communicate wirelessly at a frequency of at most 25 kHz.

* * * * *